United States Patent [19]

Günter et al.

[11] 4,147,648

[45] Apr. 3, 1979

[54] BRIGHTENING COMPOSITIONS

[75] Inventors: Franz Günter, Riehen, Switzerland; Claude Eckhardt, Riedisheim, France

[73] Assignee: Ciba-Geigy Corporation, Ardsley, N.Y.

[21] Appl. No.: 810,534

[22] Filed: Jun. 27, 1977

[30] Foreign Application Priority Data

Jul. 9, 1976 [CH] Switzerland ..... 8830/76

[51] Int. Cl.$^2$ ..... C11D 3/42; C11D 9/44

[52] U.S. Cl. ..... 252/89 B; 252/89 R; 252/301.21; 260/505 C; 427/158

[58] Field of Search ..... 252/89 B, 89 R, 301.21, 252/301.22, 301.32; 252/260 CA; 427/158

[56] References Cited

U.S. PATENT DOCUMENTS 3,984,399 10/1976 Weber et al. ..... 260/240 CA

FOREIGN PATENT DOCUMENTS 2168210 8/1973 France ..... 252/89 B
1247934 9/1971 United Kingdom ..... 252/89 B
1370154 10/1974 United Kingdom ..... 252/89 B

*Primary Examiner*—Mayer Weinblatt
*Attorney, Agent, or Firm*—Prabodh I. Almaula

[57] ABSTRACT

A brightening composition consisting of a mixture of brighteners and 0 to 99.995% by weight of a commercially available washing agent, said mixture containing at least two brighteners of the formula

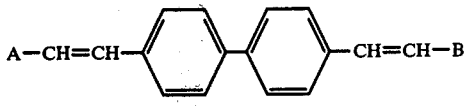

in which A and B independently of one another denote a radical of the formula

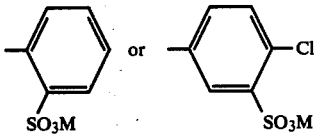

in which M represents hydrogen or an ammonium, alkaline earth metal, amine salt or alkali metal ion, as well as a process for brightening organic textiles are disclosed.

6 Claims, No Drawings

BRIGHTENING COMPOSITIONS

The present invention relates to new brightening compositions and to washing agents which contain such compositions.

Compounds which are known from the literature are, for example, 4,4'-bis-(2-sulphostyryl)-biphenyl from British Pat. No. 1,247,934 and 4,4'-bis-(4-chloro-3-sulphostyryl)-biphenyl from French Pat. No. 2,168,210. Combinations of 4,4'-bis-(styryl)-biphenyls with other optical brighteners have also been disclosed in Netherlands Published Specification No. 70-13,268. Within the scope of such brightener combinations, the specific brighteners according to the invention have proved to be extremely suitable, especially in view of the economy in use.

The brightening composition according to the invention is characterised in that it contains at least two brighteners of the formula (1)

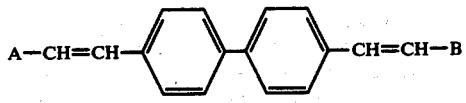

in which A and B independently of one another denote a radical of the formula (2) 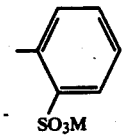 or (3) 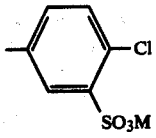

in which M represents hydrogen or an ammonium, alkaline earth metal, amine salt or, preferably, alkali metal ion, and 0 to 99,995% by weight of a commercially available washing agent.

In the case where the radicals A and B have the same meaning, that is to say when the brighteners correspond to the formulae (4)

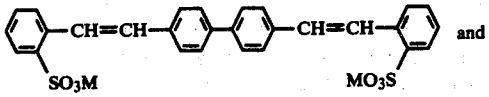

and (5)

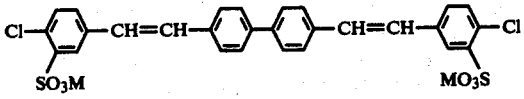

they are contained in the brightener in a ratio of (4):(5) of 1:9 to 9:1, preferably of 1:4 and especially of 1:2. However, a brightener, according to the invention, of this type can also contain between 15 and 50 percent by weight, relative to the brightener, of the brightener of the formula (6)

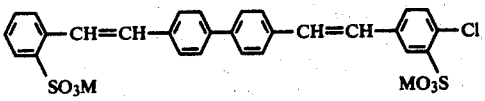

In the formalae (4), (5) and (6), M has the meaning indicated above.

The compound of the formula (6) can be manufactured according to methods which are in themselves known, thus, for example, by reacting one mol equivalent of a compound of the formula (7)

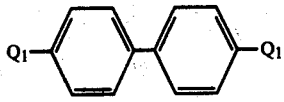

with one mol equivalent of each of the compounds of the formula (8)

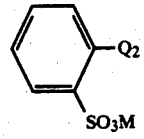

and (9)

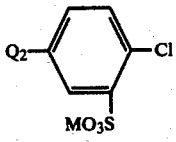

in which M has the meaning indicated above and one of the symbols $Q_1$ and $Q_2$ denotes a —CHO group and the other denotes one of the groupings of the formulae

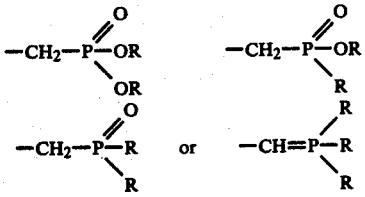

in which R represents an unsubstituted or substituted alkyl, aryl, cycloalkyl or aralkyl radical. Since, as a rule, mixtures of the compounds (4), (5) and (6) are formed during this condensation reaction and these can be separated only with effort, these mixtures are appropriately used direct for brightening.

In dissolved or finely divided states, the new brighteners defined above display a more or less pronounced fluorescence. They are therefore used, according to the invention, for optically brightening synthetic or natural organic materials.

Examples of such materials which may be mentioned, without the review given below being intended to express any limitation thereto, are textile fibres from the following groups of organic materials, insofar as optical brightening thereof enters into consideration:

(a) Polyamides which are obtainable as polymerisation products by ring opening, for example those of the polycaprolactam type, (b) polyamides which are obtainable as polycondensation products based on bifunctional or polyfunctional compounds with groups capable of undergoing a condensation reaction, such as hexamethylenediamine adipate and (c) natural textile organic materials of animal or vegetable origin, for example based on cellulose or proteins, such as cotton or wool, linen or silk.

The organic materials to be optically brightened can be in diverse stages of processing and are preferably finished textile products. They can, for example, be in the form of hank goods, textile filaments, yarns, twisted yarns, nonwovens, felts, textile fabrics, textile composites or knitted fabrics.

The brighteners defined above are of particular importance for the treatment of textile fabrics. The treatment of textile substrates is advantageously carried out in an aqueous medium in which the particular optical brighteners are present in a finely divided form (suspensions, so-called microdispersions and in some cases solutions). Dispersing agents, stabilisers, wetting agents and further auxiliaries can optionally be added during the treatment.

The treatment is usually carried out at temperatures of from about 20° to 140° C., for example at the boiling point of the bath or in the region thereof (about 90° C.). For the finishing, according to the invention, of textile substrates it is also possible to use solutions or emulsions in organic solvents, as are used in dyeing practice in so-called solvent dyeing (pad-thermofix method and the exhaustion dyeing process in dyeing machines).

The new optical brighteners which can be used according to the present invention can also be employed, for example, in the following use forms:

(a) In mixtures with so-called "carriers", wetting agents, softeners, swelling agents, antioxidants, light stabilisers, heat stabilisers and chemical bleaching agents (chlorite bleach and bleaching bath additives).

(b) In mixtures with crosslinking agents and finishing agents (for example starch or synthetic finishing agents) and also in combination with very diverse textile finishing processes, especially synthetic resin finishes (for example crease-resistant finishes, such as "wash-and-wear", "permanent press" and "no-iron"), and also flame resistant finishes, soft handle finishes, anti-soiling finishes or anti-static finishes or antimicrobial finishes.

(c) As additives to various soaps and washing agents.

(d) In combination with other substances having an optical brightening action.

If the brightening process is combined with textile treatment or finishing methods, the combined treatment can in many cases advantageously be effected with the aid of corresponding stable formulations which contain the compounds having an optical brightening action in a concentration such that the desired brightening effect is obtained.

In certain cases, the full effect of the brighteners is achieved by an after-treatment. This can be, for example, a chemical treatment (for example acid treatment), a thermal treatment (for example heat) or a combined chemical/heat treatment.

The amount of the new optical brighteners to be used according to the invention, relative to the material to be optically brightened, can vary within wide limits. A distinct and durable effect can already be achieved with very small amounts and in certain cases, for example, with amounts of 0.03 percent by weight. However, amounts of up to about 0.5 percent by weight can also be used. For most cases of interest in practice, amounts of between 0.05 and 0.5 percent by weight, relative to the material to be brightened, are preferably of interest.

The new optical brighteners are also especially suitable as additives for washing baths or to industrial and household washing agents and they can be added in various ways. They are appropriately added to washing baths in the form of their solutions in water or organic solvents or also in a state of fine division as aqueous dispersions. They, or their components, are advantageously added to household or industrial washing agents at any phase of the manufacturing process of the washing agent, for example to the so-called "slurry" prior to spray-drying of the washing powder or during the preparation of liquid washing agent combinations. The compounds can be added both in the form of a solution or dispersion in water or other solvents and also without auxiliaries in the form of a dry brightener powder. The brighteners can, for example, be mixed, kneaded or ground with the detergent substances and thus mixed with the finished washing powder. However, they can also be sprayed, in the dissolved or predispersed form, onto the finished washing agent.

Washing agents which can be used are the known mixtures of detergent substances, such as, for example, soap in the form of chips and powders, synthetic products, soluble salts of sulphonic acid half-esters of higher fatty alcohols, arylsulphonic acids, which are substituted by higher alkyl and/or polysubstituted by alkyl, carboxylic acid esters with alcohols of medium to higher molecular weight, fatty acid acylaminoalkyl- or -aminoaryl-glycerol-sulphonates, phosphoric acid esters of fatty alcohols and the like. So-called "builders" which can be used are, for example, alkali metal polyphosphates and alkali metal polymetaphosphates, alkali metal pyrophosphates, alkali metal salts of carboxymethylcellulose and other "soil redeposition inhibitors", and also alkali metal silicates, alkali metal carbonates, alkali metal borates, alkali metal perborates, nitrilotriacetic acid, ethylenediamine-tetraacetic acid and foam stabilisers, such as alkanolamides of higher fatty acids. Furthermore, the washing agents can contain, for example: antistatic agents, superfatting skin protection agents, such as lanolin, enzymes, antimicrobial agents, perfumes and dyestuffs.

The new brighteners have the particular advantage that they are also effective in the presence of active chlorine donors, such as, for example, hypochlorite, and can be used without substantial loss of the effects in washing baths with non-ionic washing agents, for example alkylphenol polyglycol ethers. Also in the presence of perborate and activators, e.g. tetraacetylglycoluril or ethylenediamine-tetraacetic acid are the new brighteners very stable both in pulverulent washing agent and in washing baths.

The brighteners according to the invention are added in amounts of 0.005 to 2% or more and preferably of 0.03 to 0.5%, relative to the weight of the liquid or pulverulent ready-to-use washing agent. When they are used to wash textiles made of cellulose fibres, polyamide fibres, cellulose fibres with a high grade finish, wool and the like, wash liquors which contain the indicated amounts of the optical brighteners according to the invention impart a brilliant appearance in daylight.

Similar results are also obtained when the compound of the formula (5) is used together with the brightener 4,4'-bis-[4-phenyl-v-triazol-2-yl]-stilbene-2,2'-disulphonic acid or salts thereof.

The washing treatment is carried out, for example, as follows:

The indicated textiles are treated for 1 to 30 minutes at 5° to 100° C. and preferably at 25° to 100° C. in a wash bath which contains 1 to 10 g/kg of a composite washing agent containing builders and 0.05 to 1%, relative to the weight of washing agent, of the brighteners claimed. The liquor ratio can be 1:3 to 1:50. After washing, the textiles are rinsed and dried in the customary manner. The wash bath can contain, as a bleach additive, 0.2 g/l of active chlorine (for example in the form of hypochlorite) or 0.1 to 2 g/l of sodium perborate.

The brighteners according to the invention can also be applied from a rinsing bath with a "carrier". For this purpose, the brightener is incorporated in a soft rinsing agent or in another rinsing agent, which contains, as the "carrier", for example, polyvinyl alcohol, starch, copolymers on an acrylic basis or formaldehyde/urea or ethylene-urea or propylene-urea derivatives, in amounts of 0.005 to 5% or more and preferably of 0.2 to 2%, relative to the rinsing agent. When used in amounts of 1 to 100 ml, and preferably of 2 to 25 ml, per liter of rinsing bath, rinsing agents of this type, which contain the brighteners according to the invention, impart brilliant brightening effects to very diverse types of treated textiles.

In the examples which follow, percentages are always percentages by weight and melting points and boiling points are uncorrected unless otherwise stated.

EXAMPLE 1

28.9 g of sodium 4-chlorobenzaldehyde-3-sulphonate (92.4% pure), 24.5 g of sodium benzaldehyde-2-sulphonate (93.7% pure) and 40.6 g of 4,4'-bis-(dimethylphosphonomethyl)-biphenyl (98% pure) are dissolved in 500 ml of dimethylsulphoxide at 40° C., whilst stirring and displacing the air by nitrogen. 14.6 g of sodium methylate (96.1% pure) are added in the course of 15 minutes and during the addition the temperature is kept between 40° and 45° C. by cooling with ice. The resulting suspension is stirred for a further 1 hour at 40° to 45° C. and then poured into 5,000 ml of desalinated water at 90° C. After adding 1,000 g of sodium chloride, the mixture is left to cool to room temperature, whilst stirring, and the product which has crystallised out is filtered off, washed with about 3,000 ml of a solution of 100 g of sodium chloride in 1,000 ml of desalinated water until neutral and dried in vacuo at 100° to 110° C. This gives 59.4 g of a mixture of the following products:

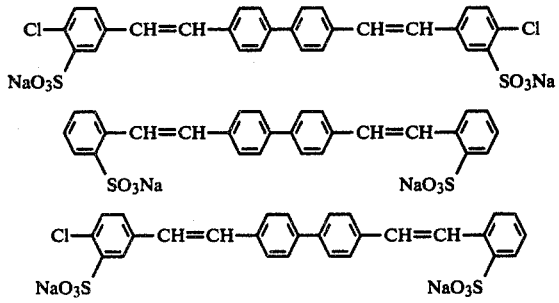

with a sodium chloride content of 5.8%.

EXAMPLE 2

Using a liquor ratio of 1:20, bleached cotton material is washed for 15 minutes in a liquor which is at 50° C. and contains, per liter, 0.05 g of a brightener consisting of the brighteners of the formulae (4) and (5) in a weight ratio of 1:2 and 4 g of a washing agent of the following composition: 15.7% of an alkylarylsulphonate, 3.7% of a fatty alcohol-sulphonate, 2.7% of coconut acid monoethanolamide, 39.0% of sodium tripolyphosphate, 4.0% of sodium silicate, 2.0% of magnesium silicate, 1.0% of carboxymethylcellulose, 0.5% of the sodium ethylenediaminetetraacetate (EDTA) and 6.7% of water, made up to 100% with sodium sulphate.

The fabric is then rinsed for 2 minutes under running cold water.

This treatment is repeated once, 3 times and 10 times with the same fabric, fresh washing solution (as described above) being used each time.

After the 10th wash, the fabric is rinsed as above and then dried for 20 minutes at 60° C. in an air drying cabinet.

The fabric treated in this way displays a distinct brightening effect with good fastness to light.

The brightening agent used is prepared by grinding the brighteners of the formulae (4) and (5) in a ball mill until the mixture is homogeneous.

EXAMPLE 3

An aqueous slurry of the following composition: 8% of sodium dodecylbenzenesulphonate, 2% of a sodium fatty alcohol-sulphonate, 1.3% of coconut acid monoethanolamide, 19.5% of sodium tripolyphosphate, 2% of sodium silicate, 1% of magnesium silicate, 0.5% of carboxymethylcellulose, 0.2% of sodium ethylenediaminetetraacetate, 12% of sodium sulphate, 0.1% of the product prepared in Example 1 and 53.4% of water, is prepared in a mortar by stirring well.

This slurry is poured into a porcelain dish and dried in a drying cabinet at about 80° C. and under 400 to 500 mm Hg for 3 hours, loosened and dried again for 3 hours at 80° C. under 200 to 300 mm Hg.

The resulting composition is then pressed through a sieve with 0.8 mm mesh width, under which another sieve with a mesh width of 0.315 mm is located.

If a cotton fabric is washed, using a liquor ratio of 1:20, for 15 minutes in a liquor which is at 50° C. and contains, per liter, 4 g of the washing powder prepared in this way, and then rinsed for 2 minutes under running cold water, centrifuged for 1 minute and dried in an air drying cabinet at 60° C., the treated fabric displays a distinct brightening effect with good fastness to light.

EXAMPLE 4

200 mg of the product prepared according to Example 1 are mixed together with 100 g of a brightener-free washing agent of the following composition: 16% of sodium dodecylbenzene-sulphonate, 4% of a sodium fatty alcohol-sulphonate, 3% of coconut acid monoethanolamide, 39% of sodium tripolyphosphate, 4% of sodium silicate, 2% of magnesium silicate, 1% of carboxymethyl-cellulose, 0.5% of sodium ethylenediaminetetraacetate and 6.5% of water, made up to 100% with sodium sulphate, by grinding for 3 hours in a ball mill (containing 4 porcelain balls) in order to obtain good homogeneity.

If a cotton fabric is treated with this washing agent under conditions the same as those described in Example 3, the treated fabric displays a distinct brightening effect with good fastness to light.

What we claim is:

1. A brightening composition consisting of a mixture of brighteners and 0 to 99,995% by weight of a conventional washing agent, said mixture consisting of at least two brighteners of the formula

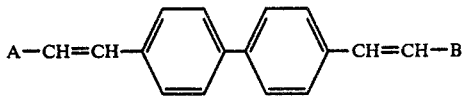

in which A and B independently of one another denote a radical of the formula

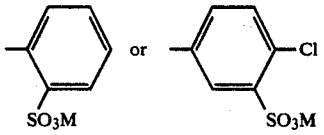

in which M represents hydrogen or an ammonium, alkaline earth metal, amine salt or alkali metal ion and wherein said brighteners are in a ratio of 1:9 to 9:1 in case A and B are the same and in a ratio of 1:1:2 to 2.8:2.8:1 in case A and B are different.

2. A brightening composition according to claim 1, consisting of the brighteners of the formula

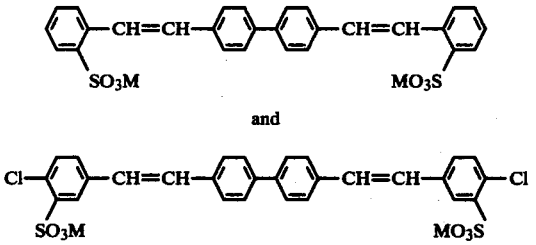

in a ratio of 1:4.

3. A process for brightening organic textile materials, which comprises applying to the material to be brightened a brightening composition consisting of at least two brighteners of the formula

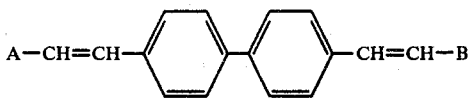

in which A and B independently of one another denote a radical of the formula

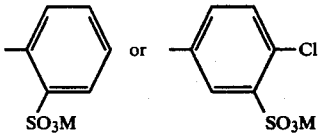

in which M represents hydrogen or a ammonium, alkaline earth metal, amine salt or alkali metal ion and wherein said brighteners are in a ratio of 1:9 to 9:1 in case A and B are the same and in a ratio of 1:1:2 to 2.8:2.8:1 in case A and B are different.

4. A process according to claim 3, which comprises using a brightening composition consisting of the brighteners of the formula

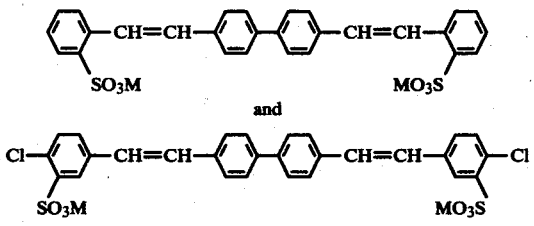

in a ratio of 1:2.

5. A process according to claim 3, which comprises using an aqueous wash liquor in order to apply the brightener.

6. A process according to claim 3, for brightening cotton, polyamides and wool as organic textile materials.

* * * * *